US005607020A

United States Patent [19]

Gebhardt

[11] Patent Number: 5,607,020

[45] Date of Patent: Mar. 4, 1997

[54] REMOTE CONTROLLED, PORTABLE DELUGE SYSTEMS AND METHOD

[76] Inventor: Godfred L. Gebhardt, P.O. Box 2465, Spring, Tex. 77389

[21] Appl. No.: 186,330

[22] Filed: Jan. 24, 1994

[51] Int. Cl.[6] ..... A62C 13/00

[52] U.S. Cl. ..... 169/48; 169/52; 169/9; 169/71

[58] Field of Search ..... 169/52, 61, 9, 169/71, 24, 48

[56] References Cited

U.S. PATENT DOCUMENTS

| | | | |
|---|---|---|---|
| 458,561 | 9/1891 | Dickson et al. | 169/9 |
| 2,923,360 | 2/1960 | Porter | 169/9 |
| 2,933,139 | 4/1960 | O'Rear | 169/9 |
| 3,040,816 | 6/1962 | Slough | 169/9 |
| 3,375,875 | 4/1968 | Wesson | 169/9 |
| 3,713,491 | 1/1973 | Grabowski et al. | 169/61 |
| 3,762,478 | 10/1973 | Cummins | 169/24 |
| 3,786,869 | 1/1974 | McLoughlin | 169/24 |
| 3,878,896 | 4/1975 | White et al. | 169/9 |
| 3,981,618 | 9/1976 | Nelson | 169/24 |
| 4,194,572 | 3/1980 | Thery et al. | 169/9 |
| 4,240,021 | 12/1980 | Kashima et al. | 320/2 |
| 4,246,885 | 1/1981 | Austin | 126/417 |
| 4,541,563 | 9/1985 | Uetsuhara | 239/64 |
| 4,729,434 | 3/1988 | Rorhrbach | 169/9 |
| 5,242,023 | 9/1993 | Terry et al. | 169/9 |

FOREIGN PATENT DOCUMENTS

| | | | |
|---|---|---|---|
| 247211 | 12/1987 | European Pat. Off. | 169/52 |
| 2646782 | 11/1990 | France | 169/52 |
| 672769 | 5/1952 | United Kingdom | 169/9 |

*Primary Examiner*—Gary C. Hoge
*Attorney, Agent, or Firm*—Gunn & Associates, P.C.

[57] ABSTRACT

A portable, pallet-mountable, remotely controlled deluge system provides a means for rapidly delivering a large quantity of a liquid to a region of hazardous materials or a fire. An accumulator, mounted, for example, on a pallet is charged with a quantity of water, aqueous film-forming foam, or other liquid quenching agent. The liquid is pressurized with an inert gas and the liquid is held in the accumulator by an electric/hydraulic valve. The valve is connected to a control panel which is wired to a remote control. The control panel also includes an antenna to receive a remote control signal by electromagnetic communication. The system provides a method of quickly getting a fire-fighting liquid or a deluging liquid to a scene of a fire or a hazardous waste spill without subjecting personnel to the hazard.

15 Claims, 1 Drawing Sheet

REMOTE CONTROLLED, PORTABLE DELUGE SYSTEMS AND METHOD

FIELD OF THE INVENTION

The present invention relates generally to the field of personal protection systems and, more particularly, to a portable system that rapidly deluges a fire or hazardous material with a quenching stream of water or other fluid under pressure to prevent ignition of the hazardous material or to protect personnel from the heat of a fire.

BACKGROUND OF THE INVENTION

Firefighters and other workers in hazardous areas often use a deluge system to set up a screen of water or foam between As vividly depicted in themselves of the source of the conflagration. the movie "The Fires Of Kuwait," a fine spray of water under pressure enables firefighters and well control specialists to get close enough to a fire to carry out their tasks, whereas, without the deluge, their proximity to the fire would otherwise prove fatal.

The deluge system used is not actually intended to extinguish the fire but rather to permit the workers to get close enough to the fire to employ other techniques and systems to put out the fire. The same or similar systems are used in other situations as well. For example, a deluge system may provide protection to workers as a precautionary measure in anticipation of a fire, explosion, or the uncontrolled release of hazardous or toxic materials.

The deluge system of the present invention finds broad application in the oil and gas industry, such as in coil tubing operations, snubbing or hydraulic workover operations, and onshore or offshore drilling. Furthermore, this deluge system provides efficient and cost effective applications to hot work in petro-chemical plants or hazardous materials operations. It also significantly improves upon currently known and available systems used at the site of train derailments and crash sites at auto races. In fact, the present invention may be scaled to be installed in a race car to automatically deploy or with a remote activation backup. In the race car such as a drag racer, the driver can activate the system without assistance to activate temporary cooling until he can climb out of the vehicle.

In addition to well control applications as previously mentioned, the present invention may be advantageously applied to all manner of fuel transport, whether by truck, train, or seagoing vessel, and to aviation fuel handling and transport. Finally, the deluge system as disclosed herein may find application at piers, docks, and terminals, particularly where petroleum products and chemicals are commonly handled.

Known systems for such applications are large, bulky devices that often require a separate source of pressurized water. Until now, the only systems that were available included an engine with attached centrifugal pump as the pressure source. Such a system requires a water source, which is impractical for portable or mobile protection systems. These systems have relatively complex controls and operating mechanisms that increase the likelihood of failure. Further, most such known systems, due to their size and weight, are not portable to permit their transport to a site where they are needed most. Thus, there remains a need for a deluge system that is compact and portable, yet simple in construction and operation to ensure emergency operation.

SUMMARY OF THE INVENTION

The present invention solves these and other problems of the prior art by providing a compact, portable deluge system with very few moving parts. A plurality of conventional bottles are coupled together in parallel to provide an accumulator to hold water, foam, or other fluid under pressure. The number of bottles in a particular application of the present invention will vary depending upon the particular application or operation. A remotely controlled electric/hydraulic valve holds the pressurized liquid until actuated by a remote control, either wired or wireless. The entire system (less the remote control) may be pallet or skid mounted or can be mounted on a trailer for easy transport. The present invention also includes a base skid type that may be temporarily welded or otherwise mounted on various machinery and equipment. The deluge system as disclosed herein can also be mounted on a mobile vehicle on which a conventional pump could not.

These and other features and objects of the present invention will be immediately apparent to those of skill in the art from the following detailed description when read in conjunction with the accompanying drawing figures.

DETAILED DESCRIPTION OF A PREFERRED EMBODIMENT

Figure 1:
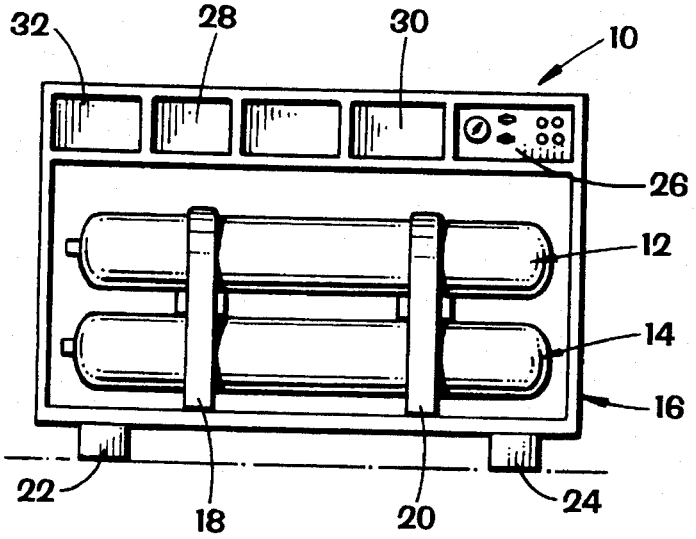
FIG. 1 depicts an elevation, side view of a portable deluge device of the present invention.

Referring now to the drawing figures, FIG. 1 shows a side view of a pallet mounted deluge system 10 of the present invention. The system 10 includes an accumulator that may be formed of a plurality of bottles 12 and 14. The bottles 12 and 14 are securely mounted on a pallet 16 by braces 18 and 20 and the bottles are quickly and easily removed and replaced. Alternatively, the bottles may be recharged after being expended of a charge of liquid and pressurized gas by retaining the bottles on the pallet 16 and hooking the accumulator to a source of the liquid and a source of the gas (see FIG. 2).

The pallet may also include a solid square tubing frame with fork lift sleeves 22 and 24 so that the system can be easily engaged by a forklift or other powered vehicle to transport the system where it is needed. The tubing frame reduces overall system mass for greater portability.

The pallet structure 16 also contains a control panel 26 which is securely mounted therein. The control panel 26 contains all of the control circuitry to operate an electric/hydraulic valve (FIG. 2) by remote control from a location distant from the pallet. The control signal from this remote location may be carried over a wire or cable from a controller to the control panel or by radio wave to an antenna on the control panel, but the preferred embodiment includes both means of carrying the control signal for redundancy and to permit actuation of the system from any of a number of sites.

The pallet also provides for one or a number of discharge hose storage compartments 28, 30, and 32. Here, a length of discharge hose may be staged and ready for immediate use. The pallet provides a secure compartment for a heavy-duty battery of conventional design in a compartment preferably adjacent to the control panel. The preferred embodiment also includes a solar panel to keep a trickle charge on the battery so that the system is immediately available for emergency use.

The pallet mount configuration is simply the presently preferred embodiment and those of skill in the art will immediately recognize other equally available configurations. For example, the system may be trailer mounted or permanently mounted on a vehicle that carries fuel or other hazardous material for automatic or remotely actuated operation of the system in the event of a problem.

Figure 2:
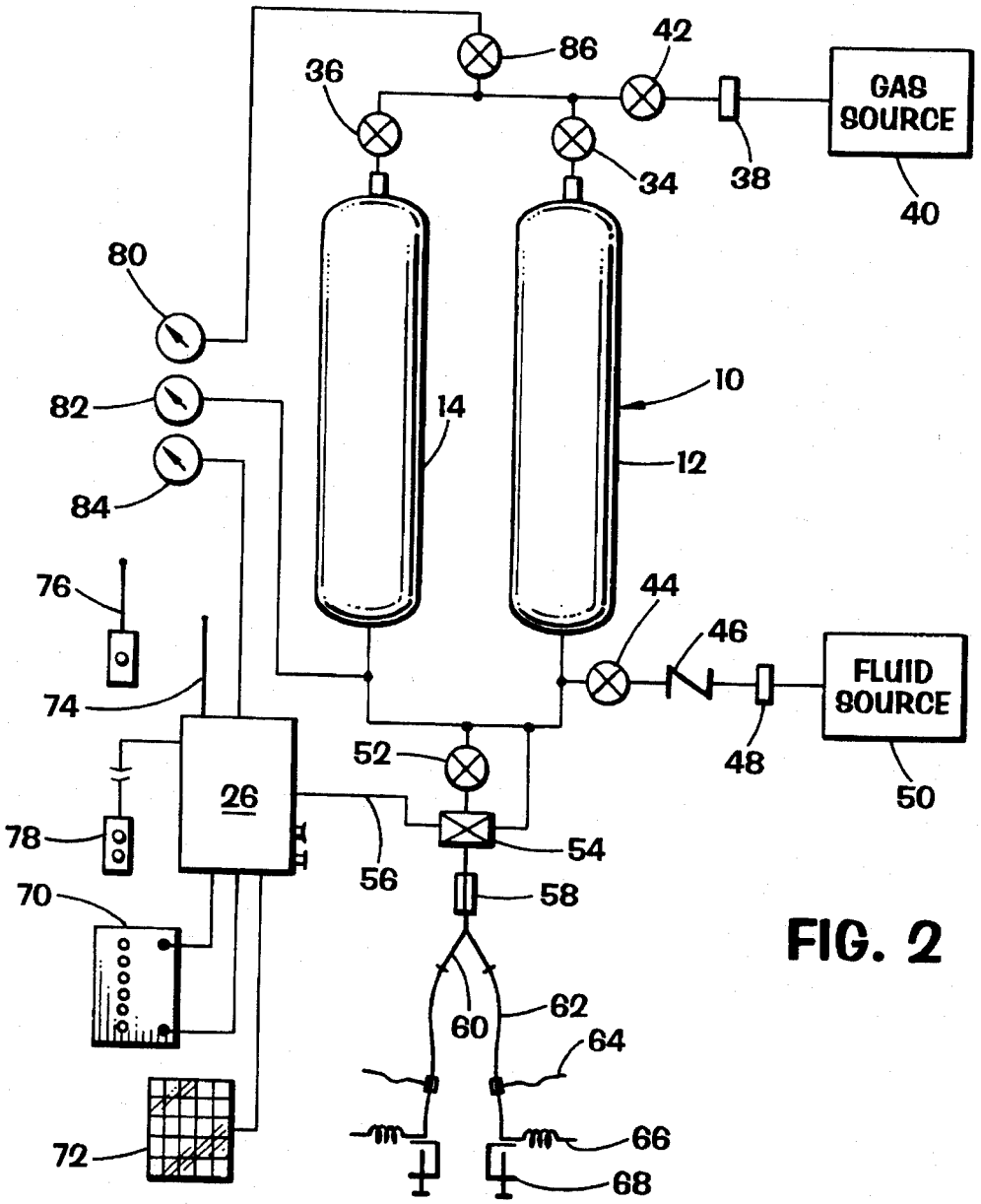
FIG. 2 depicts a schematic of the portable deluge system.

Referring now to FIG. 2, there is shown a deluge system 10 of the present invention. The system includes a pair of bottles 12 and 14 configured in parallel in such a way as to form an accumulator. The bottle 12 has associated therewith an isolation valve 34 and the bottle 14 similarly has an isolation valve 36. In certain applications, these isolation valves 34 and 36 may be deleted. These isolation valves seal off the bottles of the accumulator after they have been charged with an appropriate gas, such as nitrogen. The system also includes a fitting 38 that may be coupled to a source of gas 40 for charging the accumulator. The fitting 38 may also be isolated from the system by a valve 42.

The system further includes a valve 44, a check valve 46, and fitting 48 for coupling the system to a source of a fluid 50, such as water or aqueous film forming foam. The system may also be isolated by a valve 52 which seals off the system from an electric/hydraulic control valve 54. The electric/hydraulic control valve 54 is coupled to and controlled by the control panel 26 via a cable 56. The electric/hydraulic control valve 54 controls the flow of the fluid to a pressure reduction spool 58 to lower the pressure of the fluid for subsequent use. The pressure reduction spool 58 is preferably coupled to a distribution header 60 of any appropriate type. To the distribution header 60 are coupled a plurality of discharge hoses 62, if desired. The remainder of the fluid discharge Portion of the system comprises a tie strap 64, BETE™ nozzle or fixed fog nozzle 66, and a clamp means 68, on each discharge hose 62.

As previously mentioned, the control panel 26 provides a signal to the electric/hydraulic control valve 54 over a signal line or cable 56. The control signal may operate either on providing actuation power to the valve 54 or operate the valve upon loss of power. However, to be truly portable in the preferred embodiment, the system is operated by a battery 70 coupled to the control panel so, in order to conserve battery power, the actuation of the valve 54 should be on a power signal to the valve, rather than upon loss of power. A solar panel 72 also provides a trickle charge to the battery so that the system is always ready for emergency use.

The control panel 26 includes an antenna 74 to receive an actuation signal from a wireless remote 76. In a preferred embodiment, the wireless remote 76 operates within a 400 foot radius of the antenna 74, however, the present invention is not so limited. The system also includes a wired remote 78 for redundancy and security of the system that operates in parallel with the wireless remote 76.

Finally, the system includes sufficient gauges to assure the readiness of the system, such as a gas (nitrogen) pressure gauge 80, a fluid (water) pressure gauge 82, and a DC voltage gauge 84. Note that the gas pressure gauge 80 is isolable from the system by a valve 86.

In use, the system is first prepared by charging the accumulator bottles 12 and 14 in the system with a quantity of a liquid such as water, aqueous film forming foam, or other appropriate deluge fluid known in the art; pressurizing the liquid in the accumulator with a quantity of an inert gas, such as nitrogen; sealing off the accumulator holding the liquid and the gas with the remotely controlled actuation valve 54 (isolation valve 52 must be open for the system to be prepared for action and in some applications, this valve will also be deleted); positioning the portable system adjacent an area to be deluged; and opening the actuation valve by remote control to release the pressurized liquid. In a preferred embodiment of the present invention, the distribution header 60 is intended to a predetermined pattern of spray to provide safety to personnel and to provide an emergency stop-gap measure until a conventional deluge system can be brought to the scene and put into operation or until personnel can be extricated from the zone of danger.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without deporting from the spirit of the invention.

I claim:

1. A remotely controlled, portable deluge system for providing a protective fog screen between a person and a personnel hazard, the deluge system comprising:

a. an accumulator for storing a fluid and a gas under pressure;

b. a fluid discharge line;

c. a remotely controlled valve coupling the discharge line to the accumulator to deliver fluid from the deluge system;

d. a pressure reducing spool coupled to the fluid discharge line;

e. a plurality of discharge hoses coupled to the spool; and f. a fixed fog nozzle on each of the plurality of discharge hoses.

2. The system of claim 1 wherein the accumulator comprises a plurality of bottles.

3. The system of claim 1 further comprising a coupling for attaching the system to a source of compressed gas.

4. The system of claim 1 further comprising a coupling for attaching the system to a source of liquid.

5. The system of claim 4 further comprising a check valve adjacent the coupling.

6. The system of claim 1 wherein the remotely controlled valve comprises an electrically controlled hydraulic valve.

7. The system of claim 1 further comprising an electrical control coupled to the valve and wherein the electrical control is actuated by wireless remote control.

8. The system of claim 1 further comprising an electrical control coupled to the valve and wherein the electrical control is wired to an actuator that actuates the electrical control.

9. The system of claim 1 further comprising an electrical control coupled to the valve and wherein the electrical control is actuated by either of a wireless remote control or an actuator wired to the electrical control.

10. The system of claim 7 wherein the electrical control is battery powered and further comprising a solar cell to retain a charge on the battery power.

11. The system of claim 8 wherein the electrical control is battery powered and further comprising a solar cell to retain a charge on the battery power.

12. The system of claim 9 wherein the electrical control is battery powered and further comprising a solar cell to retain a charge on the battery power.

13. The deluge system of claim 1 further comprising a clamp means attached to each fixed fog nozzle to secure the fixed fog nozzle to a structure.

14. A pallet-mounted, remotely controlled deluge system comprising:

a. a plurality of tanks coupled together to form an accumulator to contain a quantity of a liquid under gas pressure;

b. a fluid discharge header to discharge fluid from the deluge system;

c. a remotely controlled valve coupling the accumulator to the discharge header;

d. an electrical control panel electrically connected to the remotely controlled valve;

e. a controller in communication with the control panel to remotely actuate the control valve;

f. a pressure reducing spool coupled to the discharge header;

g. a plurality of discharge hoses coupled to the spool; and h. a fixed fog nozzle on each of the plurality of discharge hoses.

15. The deluge system of claim 14 further comprising a clamp means attached to each fixed fog nozzle to secure the fixed fog nozzle to a structure.

* * * * *